US012352519B2

(12) United States Patent
Adams

(10) Patent No.: US 12,352,519 B2
(45) Date of Patent: Jul. 8, 2025

(54) LOADED-CHAMBER INDICATOR FIREARM TRIGGER DEVICE

(71) Applicant: Michael Adams, Conyers, GA (US)

(72) Inventor: Michael Adams, Conyers, GA (US)

( * ) Notice: Subject to any disclaimer, the term of this patent is extended or adjusted under 35 U.S.C. 154(b) by 0 days.

(21) Appl. No.: 18/436,153

(22) Filed: Feb. 8, 2024

(65) Prior Publication Data

US 2025/0020423 A1 Jan. 16, 2025

Related U.S. Application Data

(60) Provisional application No. 63/513,002, filed on Jul. 11, 2023.

(51) Int. Cl.
*F41A 9/53* (2006.01)
*F41A 19/10* (2006.01)

(52) U.S. Cl.
CPC ..... *F41A 9/53* (2013.01); *F41A 19/10* (2013.01)

(58) Field of Classification Search
CPC ..... F41A 9/53; F41A 19/10
See application file for complete search history.

(56) References Cited

U.S. PATENT DOCUMENTS

| | | | | |
|---|---|---|---|---|
| 5,926,987 | A | 7/1999 | Novak | |
| 7,305,786 | B2 | 12/2007 | McGarry | |
| 7,383,655 | B2 | 6/2008 | McGarry | |
| D891,438 | S | 7/2020 | Chen | |
| 2005/0229457 | A1 | 10/2005 | McGarry | |
| 2024/0200895 | A1* | 6/2024 | Geissele | F41A 17/46 |

* cited by examiner

*Primary Examiner* — J. Woodrow Eldred
(74) *Attorney, Agent, or Firm* — Brennan, Manna & Diamond, LLC

(57) ABSTRACT

A loaded-chamber indicator firearm trigger device is provided. The device is comprised of a firearm with a trigger (or only a trigger in one embodiment), wherein the trigger is comprised of an exterior side surface with at least one indicia. The indicia is only visible outside of the frame of the firearm when the firing pin of the firearm is engaged (which causes the portion of the trigger the indicia is positioned on to move outside of the frame of the firearm). As a result, the observability of the indicia on the trigger indicates the firearm has an engaged firing pin and is ready to fire.

13 Claims, 3 Drawing Sheets

LOADED-CHAMBER INDICATOR FIREARM TRIGGER DEVICE

CROSS-REFERENCE TO RELATED APPLICATION

The present application claims priority to, and the benefit of, U.S. Provisional Application No. 63/513,002, which was filed on Jul. 11, 2023, and is incorporated herein by reference in its entirety.

FIELD OF THE INVENTION

The present invention relates generally to the field of firearms. More specifically, the present invention relates to a loaded-chamber indicator firearm trigger device comprised of a firearm and/or firearm trigger with a trigger having an exterior side surface comprised of at least one indicia that is only visible when the firing pin of the firearm is engaged and the firearm is ready to fire. Accordingly, the present disclosure makes specific reference thereto. Nonetheless, it is to be appreciated that aspects of the present invention are also equally applicable to other like applications, devices, and methods of manufacture.

BACKGROUND

Pistols and other firearms, when handled while the chamber is loaded, pose a significant and often underestimated threat. This is especially true when the individual handling the weapon is unaware of its loaded state. This lack of awareness can be a critical factor leading to accidental discharges, which can have fatal consequences. Moreover, the inherent danger is amplified in cases where the firearm lacks clear visual or tactile indicators of its loaded chamber. Without these indicators, it becomes challenging for a user to ascertain whether there is a loaded round in the chamber of the firearm. This ambiguity can foster a false sense of security and complacency, leading to careless handling of the weapon.

The risk is further escalated in high-stress situations, such as during emergency responses or in a pressured environment, where the cognitive load may distract a user from performing essential safety checks. Additionally, individuals who are inexperienced with firearms are particularly vulnerable, as they might not be fully aware of the importance of verifying the weapon's status or might lack the knowledge on how to properly check the chamber. This combination of factors, the absence of clear indicators, high-stress conditions, and inexperience creates a perilous situation where the likelihood of neglecting to check the chamber markedly increases.

Therefore, there exists a long-felt need in the art for a device that indicates when a firearm has a loaded chamber. There also exists a long-felt need in the art for a loaded-chamber indicator firearm trigger device. More specifically, there exists a long-felt need in the art for a loaded-chamber indicator firearm trigger device that indicates when a firearm has a loaded chamber. Further, there exists a long-felt need in the art for a loaded-chamber indicator firearm trigger device that indicates when a firearm has a loaded chamber via a visual indicator.

The subject matter disclosed and claimed herein, in one embodiment thereof, comprises a loaded-chamber indicator firearm trigger device. The device is comprised of a firearm with a trigger (or only a trigger in one embodiment), wherein the trigger is comprised of an exterior side surface with at least one indicia. The indicia is only visible outside of the frame of the firearm when the firing pin of the firearm is engaged (which causes the portion of the trigger the indicia is positioned on to move outside of the frame of the firearm). As a result, the observability of the indicia on the trigger indicates the firearm has an engaged firing pin and is ready to fire.

In this manner, the loaded-chamber indicator firearm trigger device of the present invention accomplishes all the foregoing objectives and provides a device that indicates when a firearm has a loaded chamber. More specifically, the device indicates when a firearm has a loaded chamber. Further, the device does so in a visual manner, ensuring the firearm user can clearly identify the condition of the firearm while handling or before handling the firearm.

SUMMARY

The following presents a simplified summary to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises a loaded-chamber indicator firearm trigger device. In one embodiment, the device is comprised of a firearm with at least one trigger comprised of at least one indicia present on at least one side surface of the trigger. The indicia can only be seen when the firing pin of the firearm is engaged (i.e., when the firearm has a loaded and cocked round in the chamber) due to the position of the trigger extending from the firearm frame when said condition occurs.

More specifically, the trigger is comprised of at least one exterior side surface. The side surface can be seen when viewing the firearm from the side. The side surface is comprised of at least one indicia that alerts the user that the firearm has an engaged firing pin and a round is loaded in the chamber of the firearm ready to fire. The indicia may be any shape, symbol, text, image, etc., in different embodiments.

When the firing pin of the firearm is not engaged, the trigger only partially protrudes from the frame of the firearm. In this position, only a portion of the side surface of the trigger is visible when viewing the firearm from the side. More specifically, the portion of the side surface visible is not the area of the side surface wherein the indicia is positioned, as this portion of the side surface is concealed within the frame due to the firing pin not being engaged. In contrast, when the firing pin is engaged (i.e., when a round is loaded into the chamber and the firearm is put into battery mode) the trigger extends from the frame such that the portion of the side surface wherein the indicia is located is viewable outside of the frame.

The present invention is also comprised of a method of using the device. First, a device is provided comprised of a firearm comprised of at least one trigger with at least one exterior side surface comprised of at least one indicia that is visible only when the firing pin of the firearm is engaged and the trigger is extended from the frame to reveal the area of the side surface where the indicia is positioned. Then, the firearm can be loaded with at least one projectile and manipulated such that the firing pin of the firearm is engaged and the firearm is put into battery mode. Once the firing pin is engaged, the trigger extends from the frame such that the portion of the side surface where the indicia is located is viewable outside of the frame. Finally, a user can observe the presence of the indicia on the exterior side surface of the trigger (which is now outside of the frame due to the engagement of the firing pin) in order to be made aware that the firearm has an engaged firing pin and is ready to fire.

Accordingly, the loaded-chamber indicator firearm trigger device of the present invention is particularly advantageous as it provides a device that indicates when a firearm has a loaded chamber. More specifically, the device indicates when a firearm has a loaded chamber. Further, the device does so in a visual manner, ensuring the firearm user can clearly identify the condition of the firearm while handling or before handling the firearm. In this manner, the loaded-chamber indicator firearm trigger device overcomes the limitations of existing firearms known in the art.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION

Figure 1:
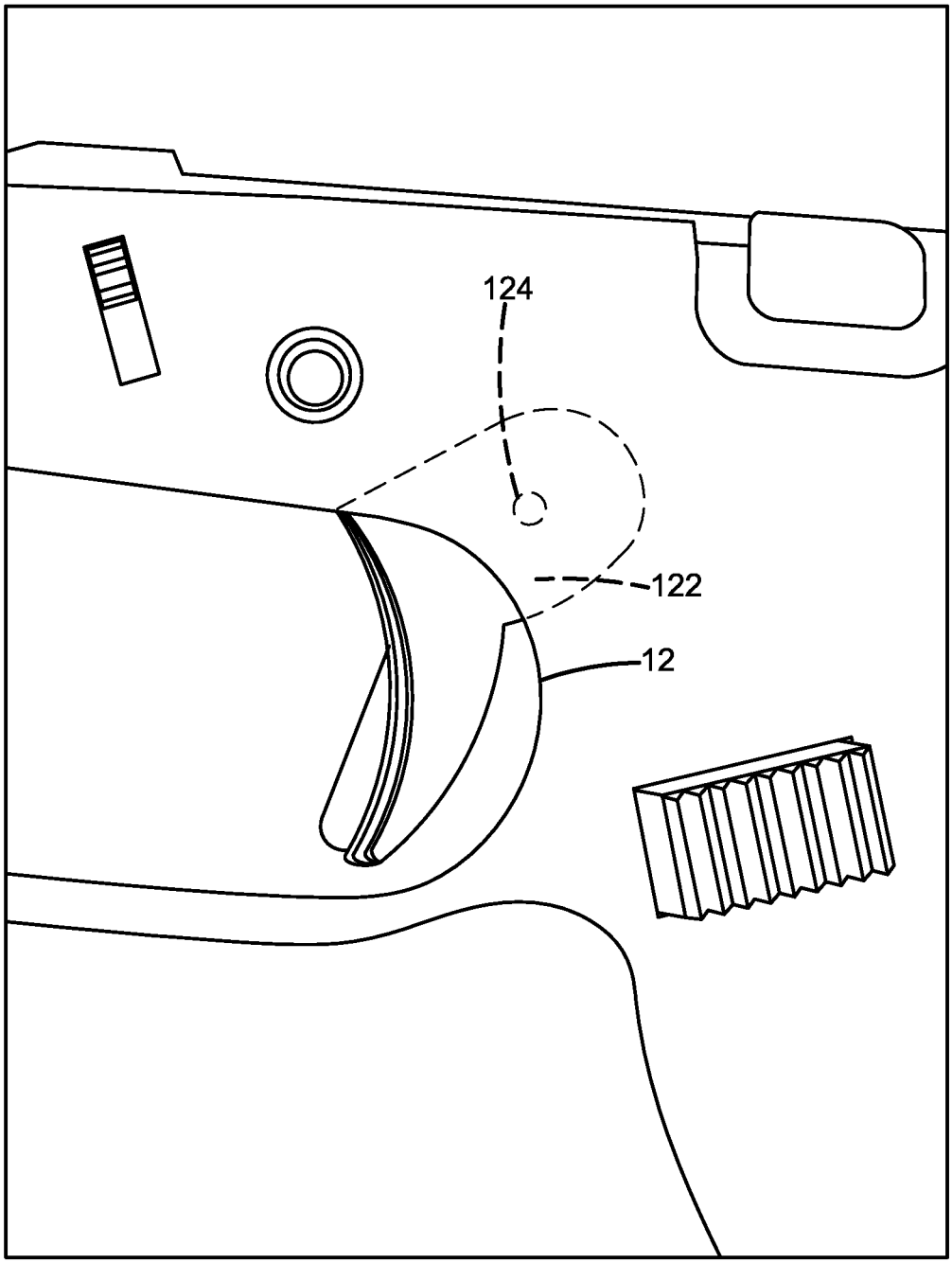
FIG. 1 illustrates a side view of one potential embodiment of a loaded-chamber indicator firearm trigger device of the present invention wherein the firing pin of the firearm is disengaged in accordance with the disclosed architecture.

The innovation is now described with reference to the drawings, wherein like reference numerals are used to refer to like elements throughout. In the following description, for purposes of explanation, numerous specific details are set forth to provide a thorough understanding thereof. It may be evident, however, that the innovation can be practiced without these specific details. In other instances, well-known structures and devices are shown in block diagram form to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there exists a long-felt need in the art for a device that indicates when a firearm has a loaded chamber. There also exists a long-felt need in the art for a loaded-chamber indicator firearm trigger device. More specifically, there exists a long-felt need in the art for a loaded-chamber indicator firearm trigger device that indicates when a firearm has a loaded chamber. Further, there exists a long-felt need in the art for a loaded-chamber indicator firearm trigger device that indicates when a firearm has a loaded chamber via a visual indicator.

The present invention, in one exemplary embodiment, is comprised of a loaded-chamber indicator firearm trigger device comprised of a firearm with at least one trigger comprised of at least one indicia present on at least one side surface of the trigger. The indicia can only be seen when the firing pin of the firearm is engaged (i.e., when the firearm has a loaded and cocked round in the chamber) due to the position of the trigger extending from the firearm frame when said condition occurs.

More specifically, the trigger is comprised of at least one exterior side surface that can be seen when viewing the firearm from the side. The side surface is comprised of at least one indicia that alerts the user that the firearm has an engaged firing pin and a round is loaded in the chamber of the firearm ready to fire. The indicia may be any shape, symbol, text, image, etc., in different embodiments.

When the firing pin of the firearm is not engaged, the trigger only partially protrudes from the frame of the firearm. In this position, only a portion of the side surface of the trigger is visible when viewing the firearm from the side. More specifically, the portion of the side surface visible is not the area of the side surface wherein the indicia is positioned, as this portion of the side surface is concealed within the frame due to the firing pin not being engaged. In contrast, when the firing pin is engaged (i.e., when a round is loaded into the chamber and the firearm is put into battery mode) the trigger extends from the frame such that the portion of the side surface wherein the indicia is located is viewable outside of the frame.

The present invention is also comprised of a method of using the device. First, a device is provided comprised of a firearm comprised of at least one trigger with at least one exterior side surface comprised of at least one indicia that is visible only when the firing pin of the firearm is engaged and the trigger is extended from the frame to reveal the area of the side surface where the indicia is positioned. Then, the firearm can be loaded with at least one projectile and manipulated such that the firing pin of the firearm is engaged and the firearm is put into battery mode. Once the firing pin is engaged, the trigger extends from the frame such that the portion of the side surface where the indicia is located is viewable outside of the frame. Finally, a user can observe the presence of the indicia on the exterior side surface of the trigger (which is now outside of the frame due to the engagement of the firing pin) in order to be made aware that the firearm has an engaged firing pin and is ready to fire.

Accordingly, the loaded-chamber indicator firearm trigger device of the present invention is particularly advantageous as it provides a device that indicates when a firearm has a loaded chamber. More specifically, the device indicates when a firearm has a loaded chamber. Further, the device does so in a visual manner, ensuring the firearm user can clearly identify the condition of the firearm while handling or before handling the firearm. In this manner, the loaded-chamber indicator firearm trigger device overcomes the limitations of existing firearms known in the art.

Referring initially to the drawings, FIG. 1 illustrates a side view of one potential embodiment of a loaded-chamber indicator firearm trigger device of the present invention wherein the firing pin of the firearm is disengaged in accordance with the disclosed architecture. In one embodiment, the device 100 is comprised of a firearm 110 with at least one trigger 120 comprised of at least one indicia 124 present on at least one side surface 122 of the trigger 120. In another embodiment, the device 100 is comprised of a trigger 120 comprised of at least one indicia 124 present on at least one side surface 122 of the trigger 120. The indicia 124 can only be seen when the firing pin 114 of the firearm 110 is engaged (i.e., when the firearm has a loaded and cocked round in the chamber) due to the position of the trigger extending from the firearm frame 112 when said condition occurs. The firearm 110 may be any firearm type in different embodiments. This includes, but is not limited to, pistols, rifles, shotguns, launchers, etc. However, in the preferred embodiment, the firearm 110 is a striker-fired pistol.

The firearm 110 is comprised of at least one trigger 120. The trigger 120 is comprised of at least one exterior side surface 122. The side surface 122 can be seen when viewing the firearm 110 from the side.

The side surface 122 is comprised of at least one indicia 124. The purpose of the indicia 124 is to alert the user that the firearm 110 has an engaged firing pin 114 and a round is loaded in the chamber of the firearm 110 ready to fire. The indicia 124 may be any shape, symbol, text, image, etc., in different embodiments. The indicia 124 may also be any color. However, the indicia 124 is preferably red. The indicia 124 may be pressed, embossed, engraved, printed onto, painted onto, paint-filled onto, etc., the exterior side surface 122.

When the firing pin 114 of the firearm 110 is not engaged, the trigger 120 only partially protrudes from the frame 112 of the firearm 110, as seen in FIG. 1. In this position, only a portion of the side surface 122 of the trigger 120 is visible when viewing the firearm 110 from the side. More specifically, the portion of the side surface 122 visible is not the area of the side surface 122 wherein the indicia 124 is positioned, as this portion of the side surface 122 is concealed within the frame 112 due to the firing pin 114 not being engaged.

Figure 2:
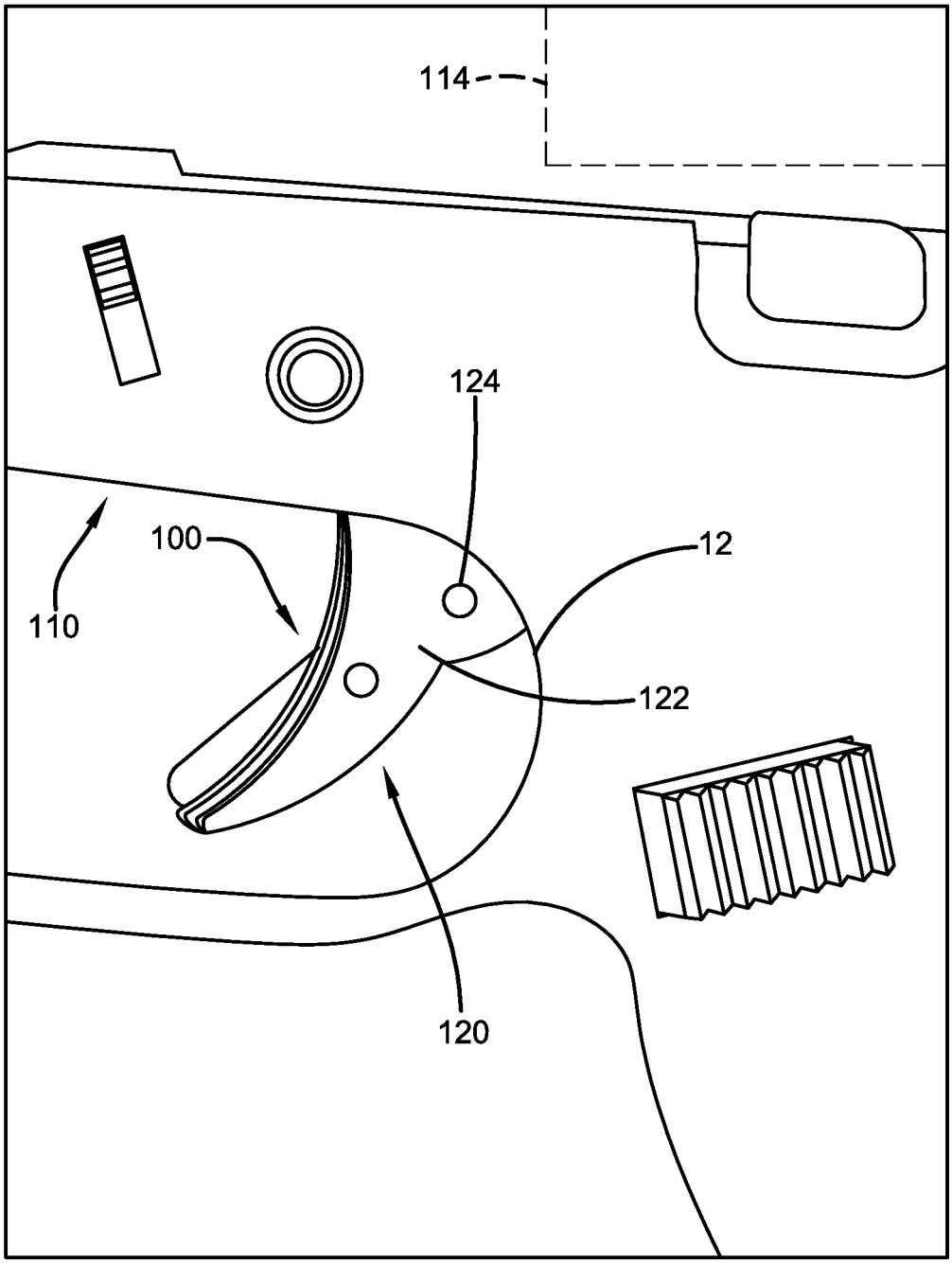
FIG. 2 illustrates a side view of one potential embodiment of a loaded-chamber indicator firearm trigger device of the present invention wherein the firing pin of the firearm is engaged in accordance with the disclosed architecture.
Figure 3:
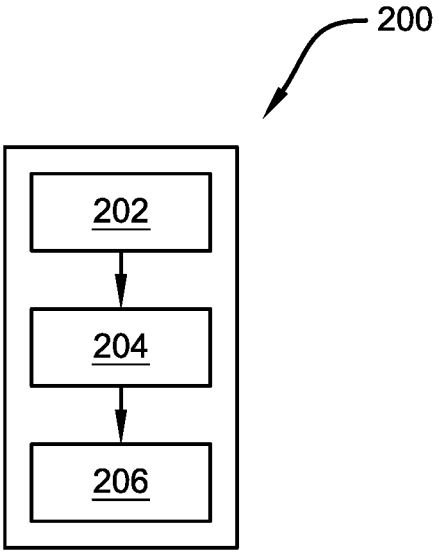
FIG. 3 illustrates a flowchart of a method of using one potential embodiment of a loaded-chamber indicator firearm trigger device of the present invention in accordance with the disclosed architecture.

In contrast, when the firing pin 114 is engaged (i.e., when a round is loaded into the chamber and the firearm 110 is put into battery mode) the trigger 120 extends from the frame 112 such that the portion of the side surface 122 wherein the indicia 124 is located is viewable outside of the frame 112, as seen in FIG. 2. Upon viewing indicia 124, a user is informed that the firing pin 114 is engaged and that the firearm 110 is ready to fire.

The present invention is also comprised of a method of using 200 the device 100, as seen in FIG. 4. First, a device 100 is provided comprised of a firearm 110 comprised of at least one trigger 120 with at least one exterior side surface 122 comprised of at least one indicia 124 that is visible only when the firing pin 114 of the firearm 110 is engaged and the trigger 120 is extended from the frame 112 to reveal the area of the side surface 122 where the indicia 124 is positioned [Step 202]. Then, the firearm 110 can be loaded with at least one projectile and manipulated such that the firing pin 114 of the firearm 110 is engaged and the firearm 110 is put into battery mode [Step 204]. It should be noted that before the firing pin 114 is engaged, the indicia 124 is not visible outside of the frame 112 due to the partial extension of the trigger 120 side surface 122 outside of the frame 112 resulting from the lack of firing pin 114 engagement. Once the firing pin 114 is engaged, the trigger 120 extends from the frame 112 such that the portion of the side surface 122 wherein the indicia 124 is located is viewable outside of the frame 112. Finally, a user can observe the presence of the indicia 124 on the exterior side surface 122 of the trigger 120 (which is now outside of the frame 112 due to the engagement of the firing pin 114) in order to be made aware that the firearm 110 has an engaged firing pin 114 and is ready to fire [Step 206].

Certain terms are used throughout the following description and claims to refer to particular features or components. As one skilled in the art will appreciate, different persons may refer to the same feature or component by different names. This document does not intend to distinguish between components or features that differ in name but not structure or function. As used herein "loaded-chamber indicator firearm trigger device" and "device" are interchangeable and refer to the loaded-chamber indicator firearm trigger device 100 of the present invention.

Notwithstanding the foregoing, the loaded-chamber indicator firearm trigger device 100 of the present invention and its various components can be of any suitable size and configuration as is known in the art without affecting the overall concept of the invention, provided that they accomplish the above-stated objectives. One of ordinary skill in the art will appreciate that the size, configuration, and material of the loaded-chamber indicator firearm trigger device 100 as shown in the FIGS. are for illustrative purposes only, and that many other sizes and shapes of the loaded-chamber indicator firearm trigger device 100 are well within the scope of the present disclosure. Although the dimensions of the loaded-chamber indicator firearm trigger device 100 are important design parameters for user convenience, the loaded-chamber indicator firearm trigger device 100 may be of any size, shape, and/or configuration that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications, and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A firearm trigger device comprising:

a firearm comprised of a trigger, the trigger comprised of an exterior side surface; and an indicia positioned on the exterior side surface, wherein the indicia is not visible outside of a frame of the firearm when a firing pin of the firearm is disengaged.

2. The firearm trigger device of claim 1, wherein the indicia is comprised of a shape, a symbol, a text, or an image.

3. The firearm trigger device of claim 1, wherein the indicia is comprised of a color.

4. The firearm trigger device of claim 3, wherein the color is red.

5. The firearm trigger device of claim 3, wherein the indicia is comprised of a circle.

6. The firearm trigger device of claim 1, wherein the indicia is embossed, engraved, printed onto, painted onto, or paint-filled onto the exterior side surface.

7. The firearm trigger device of claim 1, wherein the indicia is visible outside of a frame of the firearm when a firing pin of the firearm is engaged.

8. A method of using a loaded-chamber indicator firearm trigger device, the method comprising the following steps:

providing a loaded-chamber indicator firearm trigger device comprised of firearm comprised of a trigger comprised of an exterior side surface comprised of an indicia;

loading a projectile into the firearm and manipulating the firearm such that a firing pin of the firearm is engaged; and observing the presence of the indicia on the exterior side surface of the trigger to be made aware that the firing pin of the firearm is engaged.

9. The method of using a loaded-chamber indicator firearm trigger device of claim 8, wherein the indicia is visible outside of a frame of the firearm when the firing pin of the firearm is engaged.

10. The method of using a loaded-chamber indicator firearm trigger device of claim 8, wherein the indicia is not visible outside of a frame of the firearm when the firing pin of the firearm is disengaged.

11. The method of using a loaded-chamber indicator firearm trigger device of claim 8, wherein the indicia is comprised of a shape, a symbol, a text, or an image.

12. The method of using a loaded-chamber indicator firearm trigger device of claim 8, wherein the indicia is comprised of a color.

13. The method of using a loaded-chamber indicator firearm trigger device of claim 11, wherein the color is in a shape of a circle.

* * * * *